US005762034A

United States Patent [19]

Foss

[11] Patent Number: 5,762,034

[45] Date of Patent: Jun. 9, 1998

[54] COOLING FAN SHROUD

[75] Inventor: John F. Foss, Okemos, Mich.

[73] Assignee: Board of Trustees operating Michigan State University, East Lansing, Mich.

[21] Appl. No.: 585,880

[22] Filed: Jan. 16, 1996

[51] Int. Cl.[6] ..... F01P 7/10

[52] U.S. Cl. ..... 123/41.49; 415/58.3; 415/914

[58] Field of Search ..... 123/41.49; 415/58.2, 415/58.3, 914

[56] References Cited

U.S. PATENT DOCUMENTS

| | | | |
|---|---|---|---|
| 2,785,620 | 3/1957 | Welch | 98/2 |
| 3,799,128 | 3/1974 | Small | 123/41.49 |
| 3,937,192 | 2/1976 | Longhouse | 123/41.49 |
| 4,104,993 | 8/1978 | Baguelin | 123/41.49 |
| 4,181,172 | 1/1980 | Longhouse | 165/51 |
| 4,202,296 | 5/1980 | Nonnenmann et al. | 123/41.48 |
| 4,329,946 | 5/1982 | Longhouse | 123/41.49 |
| 4,398,508 | 8/1983 | Moon et al. | 123/41.49 |
| 4,406,581 | 9/1983 | Robb et al. | 415/172 |
| 4,548,548 | 10/1985 | Gray, III | 416/189 |
| 4,566,852 | 1/1986 | Hauser | 415/182 |
| 4,927,328 | 5/1990 | Scoates et al. | 415/220 |
| 5,216,983 | 6/1993 | Nilson | 123/41.12 |

*Primary Examiner*—Noah P. Kamen

*Attorney, Agent, or Firm*—Brinks Hofer Gilson & Lione

[57] ABSTRACT

A shroud for the cooling fan of a motor vehicle engine provides a circumferential axial flow of air between the fan blade tips and the shroud to improve fan efficiency and engine cooling. The shroud may include a circumferentially extending Coanda surface and adjacent circular throat which directs air flow toward the annulus between the shroud and the fan blade tips. Adjustment of the air pressure and throat dimension allows accurate control of the velocity profile of the air flow through the annulus.

24 Claims, 3 Drawing Sheets

FIG. 4
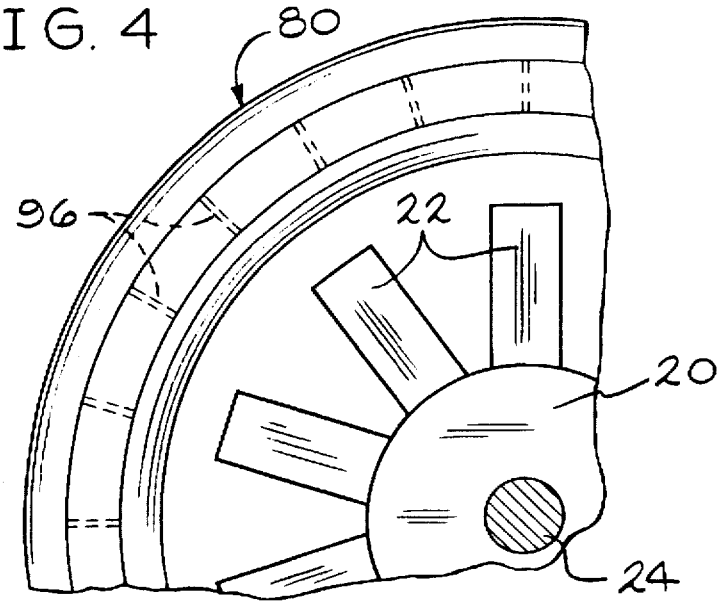
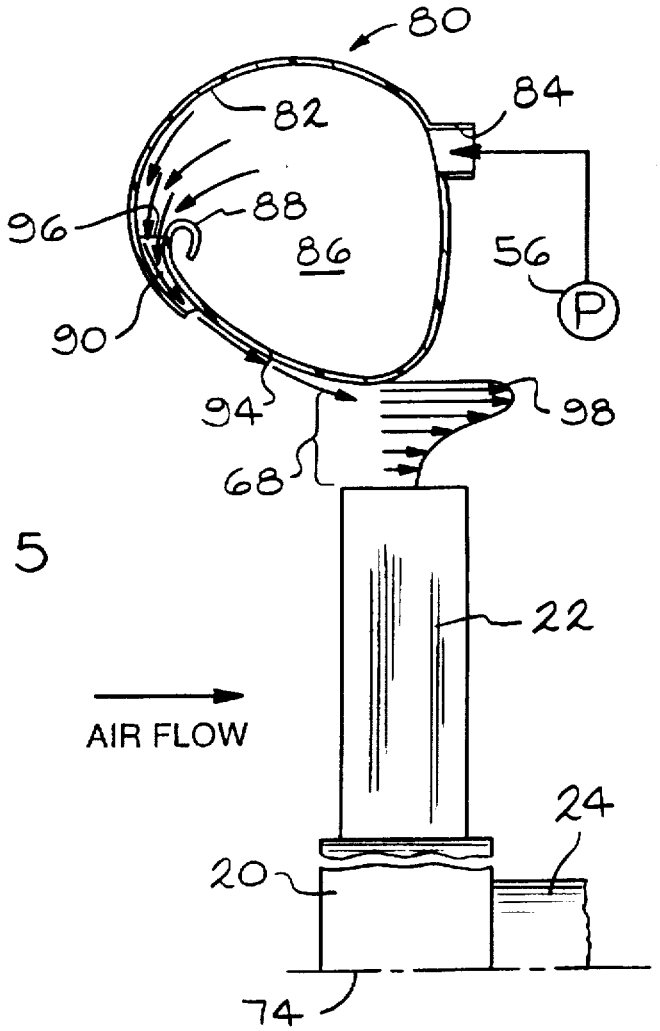
FIG. 5

COOLING FAN SHROUD

BACKGROUND OF THE INVENTION

The invention relates generally to shrouds for motor vehicle cooling fans and more particularly to a shroud for a motor vehicle engine cooling fan which utilizes a Coanda surface to provide air flow through the annulus between the fan blade tips and the shroud to improve the efficiency of the cooling fan.

As motor vehicle engine compartment designs continue to evolve in response to increasing demands of vehicle and engine efficiency, operating temperatures continue to increase while the engine compartment's frontal area and natural air flow continue to reduce. All of these considerations conspire to increase underhood operating temperatures.

Nonetheless, a vehicle traveling at highway speeds at elevated ambient temperatures presents no significant engine cooling problems. Likewise, a vehicle stopped in traffic in moderate ambient temperatures presents no significant cooling problems. The combination, however, of high ambient temperatures and operation in congested, slow moving traffic wherein air heated by one vehicle is ingested by an adjacent vehicle and heated further represents an acknowledged severe engine operating condition. A second severe operating condition known as "hot soak" occurs when the engine has been subjected to heavy load by, for example, pulling a trailer uphill and the vehicle then stops. Operation under these conditions demands operation of and dependence upon the engine driven cooling fan. Operation in these conditions also demands the highest possible efficiency from the fan in order to achieve maximum cooling and safe engine operating conditions.

Such fan efficiency is achieved by well-known and recognized parameters such as the number of fan blades and their configuration as well as a properly designed radiator/fan shroud which maximizes radiator air flow and heat transfer while minimizing leakage and back flow around the fan.

In this regard, a problem inherent in motor vehicle design typically interferes with the attainment of high fan efficiencies. This problem results from the mounting of the radiator and fan shroud to the vehicle body whereas the fan is mounted upon the engine which is, in turn, secured to the vehicle body or frame through a plurality of engine mounts. These engine mounts are typically resilient and allow controlled motion of the engine and associated drive train components relative to the body or frame in response to engine reaction torque and vehicle acceleration and deceleration. While the spacing of the fan tips from the shroud can vary depending upon the fan and shroud location relative to the engine mount, the stiffness of the engine mounts and other variables, it has been found that spacing on the order of one-half inch (12.7 mm) to one inch (25.4 mm) or more is necessary to ensure that given the greatest excursion of the engine and fan relative to the shroud and vehicle body, the fan does not contact the shroud.

Unfortunately, the introduction of an annular space of this size has a significant deleterious effect on fan efficiency. Fan efficiencies in such configurations have been determined to be on the order of sixteen percent. Viewed not only from the perspective of fan efficiency but also from the perspectives of achieving necessary engine cooling with a given fan size and overall engine efficiency and fuel consumption, this is not a desirable figure. Accordingly, it is apparent that improvements in the configuration of motor vehicle cooling fans which provide improved fan efficiency and thus motor vehicle cooling are desirable.

SUMMARY OF THE INVENTION

A shroud for the cooling fan of a motor vehicle engine provides a circumferential axial flow of air between the fan blade tips and the shroud to improve fan efficiency and engine cooling. The shroud preferably includes an interior flow distribution passageway (shroud plenum) and a circumferentially extending Coanda surface and adjacent circular throat which directs air flow toward the annulus between the shroud and the fan blade tips. Air is provided to the shroud plenum at a pressure of between about 2 and 10 inches water gauge (4 to 20 Torr). Adjustment of the air pressure and throat dimension allows accurate control of the velocity profile of the air flow through the annulus. An alternate embodiment molded or formed shroud is also disclosed.

It is thus an object of the present invention to provide a motor vehicle cooling fan shroud which provides increased fan efficiency.

It is a further object of the present invention to provide a motor vehicle cooling fan shroud which utilizes the Coanda effect to improve fan efficiency.

It is a still further object of the present invention to provide a motor vehicle cooling fan shroud wherein adjustment of the air pressure provided to the shroud plenum and adjustment of the dimensions of the outlet throat may be made to control the velocity profile of the air passing between the fan blade and the shroud.

It is a still further object of the present invention to provide a motor vehicle cooling fan shroud which reduces back flow through the annulus between the tips of the fan blade and the shroud.

It is a still further object of the present invention to provide a motor vehicle cooling fan shroud which provides good fan efficiency notwithstanding the existence of a significant annular space between the fan blade tips and shroud.

Further objects and advantages of the present invention will become apparent by reference to the following description of the preferred and alternate embodiments and appended drawings wherein like reference numerals refer to the same element, feature or component.

BRIEF DESCRIPTION OF THE DRAWINGS

FIG. 4 is fragmentary view of a portion of motor vehicle engine cooling fan and alternate embodiment shroud according to the present invention;

FIG. 5 is fragmentary view and partial section of a motor vehicle engine cooling fan and alternate embodiment shroud according the present invention.

DESCRIPTION OF THE PREFERRED AND ALTERNATE EMBODIMENTS

Figure 1:
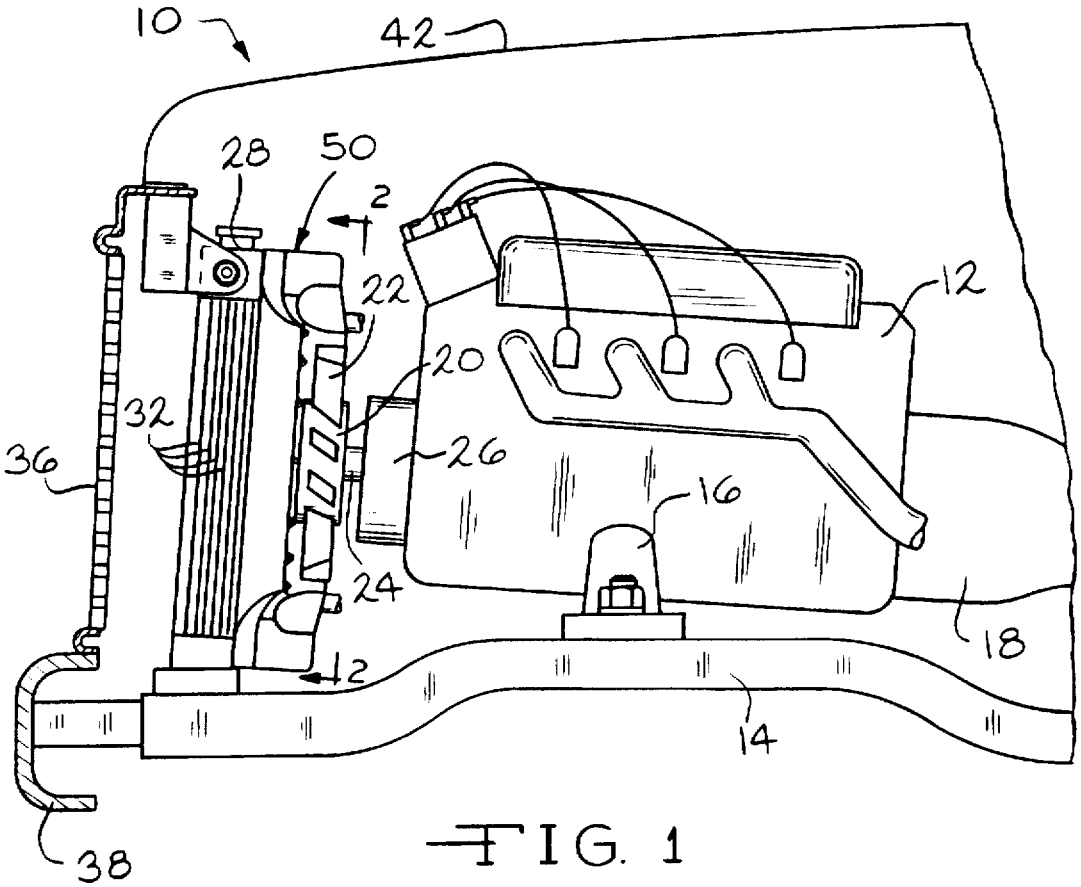
FIG. 1 is a diagrammatic side, elevational view in partial section of a motor vehicle engine cooling fan, radiator and shroud according to the present invention.

Referring now to FIG. 1, a forward portion of a motor vehicle is illustrated and generally designated by the reference numeral 10. The motor vehicle 10 includes a prime mover 12 which may be either a Diesel engine, Otto cycle engine as illustrated or other heat generating power plant. The prime mover 12 is secured to the frame 14 or other body structure by a plurality of resilient engine mounts 16 one of which is illustrated in FIG. 1. The engine mounts 16 damp vibration and allow limited and controlled motion of the prime mover 12 relative to the frame or unibody 14 of the motor vehicle 10. The power generated by the prime mover 12 is transferred through a transmission 18 to associated driveline components (not illustrated). At the forward end of the prime mover 12, generally centrally disposed thereon is a fan 20 having a plurality of radially and obliquely oriented fan blades 22. The fan 20 may be disposed upon a shaft 24 of a water pump 26 or may be independently mounted, as desired. Forward of the fan 20 is a radiator 28. The radiator 28 is conventional and functions as a heat exchanger, receiving a flow of engine coolant through internal, vertical or horizontal passageways 32. The engine coolant gives up heat to air which moves horizontally, that is, from left to right in FIG. 1, through the radiator 28.

A decorative grill 36 is disposed forward of the radiator 28 and provides an attractive appearance as well as a modicum of protection to the radiator 28. A bumper 38 is secured to the frame or unibody 14 and also protects the forward end of the motor vehicle 10. A hinged hood 42 covers the prime mover 12 and other components in the engine compartment as will be readily appreciated.

Figure 2:
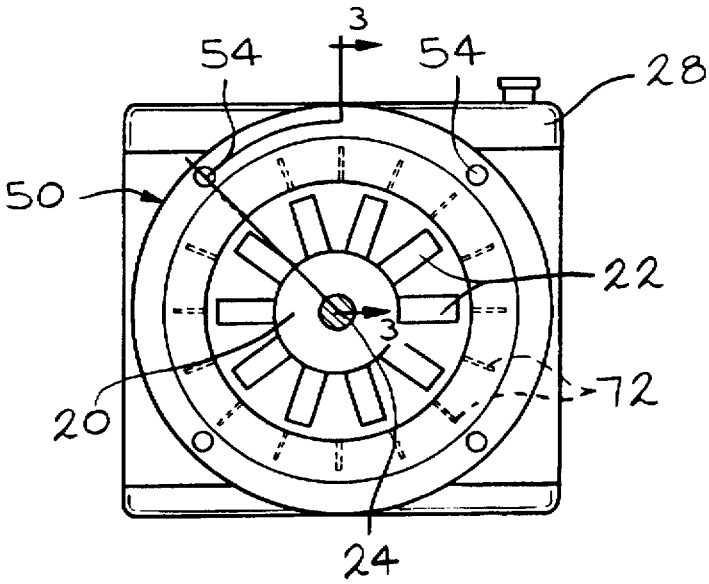
FIG. 2 is a rear, elevational view of a motor vehicle engine cooling fan, radiator and shroud according to the present invention taken along line 2—2 of FIG. 1.

Referring now to FIGS. 1 and 2, disposed intermediate and proximate the fan 20 and radiator 28 is a fan shroud 50. The fan shroud 50 is secured to and moves with the radiator 28 which, in turn, is securely fastened to the frame or unibody 14. As noted above, since the fan 20 is attached to the prime mover 12 and the prime mover 12 is secured to the frame or unibody 14 through resilient engine mounts 16, relative motion can and does occur between the fan 20 and the fan shroud 50. In a typical truck application, it has been found necessary to allow approximately one inch (25.4 mm) clearance between the tips of the fan blades 22 and the most proximate, that is, radially adjacent and aligned, surface of the fan shroud 50. Assuming the fan 22 defines a diameter of 20 inches (508 mm), the one inch (25.4 mm) annular spacing between the tips of the blade 22 and the fan shroud 50 constitutes an area of 66 square inches (425.4 square cm). Given such a fan and shroud configuration, fan efficiencies on the order of 16% have been observed. It is believed that such efficiencies are the result of significant backflow through the annulus defined by the tips of the fan blades 22 and the most proximate surface of the fan shroud 50. The imposed axial flow will also limit the localized flow from the pressure-side to the suction-side of the fan blade. Thus localized flow contributes to the "tip loss" phenomenon of such fans.

Figure 3:
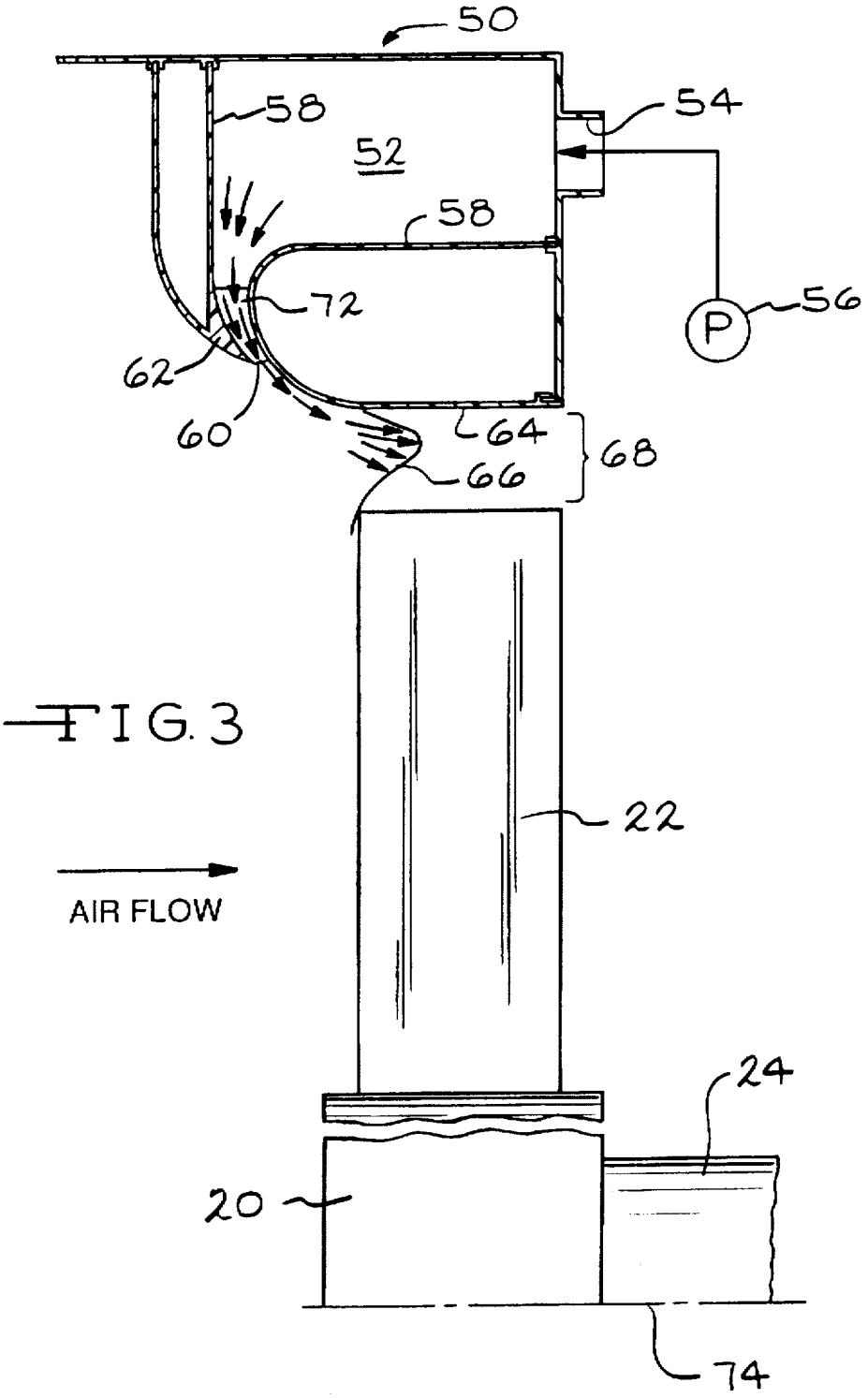
FIG. 3 is a fragmentary, sectional view of a motor vehicle engine cooling fan and shroud according to the present invention taken along line 3—3 of FIG. 2.

Referring now to FIGS. 2 and 3, the fan shroud 50 defines a circumferentially continuous interior passageway or plenum 52. The circumferential plenum 52 preferably is in fluid communication with a plurality of inlet ports 54 which, in turn, communicate with one or more sources of low pressure air such as a pump 56. Although a single inlet port 54 will suffice to pressurize the plenum 52 improved air distribution and operation is achieved with multiple ports 54. The air is preferably provided at a pressure of between about 3 to 5 inches of water gauge or about 6 to 10 Torr. Depending upon the flow characteristics desired, the pressure in the engine compartment and other variables, it is anticipated that an operable range for such air pressure is from about 2 to about 10 inches of water gauge (4 Torr to 10 Torr). The shroud 50 includes interior walls 58 which define the passageway or plenum 52 and converge to a throat 60. An overhanging lip 62 defines one portion of the throat 60 and the other portion of the throat 60 is defined by a curved circumferential Coanda surface 64. The Coanda surface 64 causes the air moving through the throat 60 to continue to curve along the Coanda surface 64 thereby providing an air flow having a representative velocity profile 66 and directing air flow through the annular space 68 between the Coanda surface 64 and the tips of the fan blades 22. A plurality of radially disposed webs 72 which span the throat 60 ensure maintenance of the desired width of the throat 60 and generally strengthen the shroud 50.

The interior walls 56, the throat 60, the lip 62 and the Coanda surface 64 are preferably axisymmetric about a center reference axis 74. Viewing the profile of the Coanda surface 64 and the overhanging lip 62, it will be appreciated that the utilization of a Coanda surface 64 not only achieves air flow in the annular space 68 but presents a smooth aerodynamic surface to the air passing through the peripheral regions of the radiator 28 as it moves towards the fan 20, thereby also improving fan efficiency.

Referring now to FIG. 4 and 5, a first alternate embodiment fan shroud is illustrated and designated by the reference numeral 80. The first alternate embodiment fan shroud 80 defines a formed or curled body having an axisymmetric shape suggestive of a torus. Thus the cross section illustrated in FIG. 5 generally represents the cross section of the fan shroud 80 about its circumference, with certain exceptions. The exceptions relate to the plurality of air inlet ports 84 which provide fluid communication into the interior or plenum 86 of the shroud 80 at a plurality of circumferential locations about the shroud 80. Once again, it is believed that a plurality of inlet ports 84 provide uniform airflow and thus optimum operation. However, it should be appreciated that construction and operation with, for example, a single or double inlet ports 84 is readily possible.

The continuous sidewall 82 of the shroud 80 is formed into a reverse curved terminal portion 88 on the interior which provides an appropriately streamlined surface as the air travels toward a throat 90. The throat 90 is, of course, defined by the continuous curved sidewall 82 which is a Coanda surface 94 which directs airflow into the annular space 68 between the tips of the fan blades 22 and the first alternate embodiment shroud 80. Circumferentially spaced around the shroud 80 at a plurality of locations between the portions of the sidewall 82 which define the throat 90 are webs 96 which maintain the shape of the throat 90 and thus maintain the desired air velocity profile 98 illustrated schematically in FIG. 5.

In this regard, it will be appreciated that the precise size and shape, that is, the profile of the curved Coanda surfaces 64 and 94 of the preferred and alternate embodiment shrouds 50 and 80, respectively, is not critical to obtaining a desired velocity profile. Rather, the width of the throats 60 and 90 and the pressure of the air provided to the plenums 52 and 86 of the shrouds 50 and 80, respectively provide readily adjustable parameters by which the velocity profile may be adjusted to provide optimum operation and fan efficiency in differing applications and operating conditions. Furthermore, the present invention is deemed to include the real time adjustment of air pressure delivered to the plenums 52 and 86 in response to one or more sensed variables such as underhood temperature, ambient temperature, engine compartment pressure or engine speed to change the velocity profile of the air delivered to the annular space 68 by the fan shrouds 50 and 80.

The preferred and alternate embodiment shrouds 50 and 80, respectively, both incorporate the present invention but disclose differences based primarily on different approaches to the manufacture and assembly of the shrouds. The preferred embodiment shroud 50, as illustrated in FIG. 3, may be fabricated of three or more molded plastic pieces which are fit together with mating edges and channels aligned and then secured by suitable adhesives. The alternate embodiment shroud 80 illustrated in FIG. 5 is, however, preferably fabricated of a single piece of plastic molded material with edges which are curled and overlapped to form the final product. In either event, it is anticipated that the shrouds 50 and 80 may be molded of a temperature resistant plastic such as acrylonitrile-butadiene-styrene (ABS). In thermosetting form, i.e., cured or crosslinked, it is suitable for the fabrication of the preferred embodiment shroud 50. Alternatively, ABS in a thermoplastic form, i.e., uncured or non-crosslinked, is suitable for the molding of the alternate embodiment shroud 80 which requires additional forming (curling) after the initial molding.

The foregoing disclosure is the best mode devised by the inventor for practicing this invention. It is apparent, however, that apparatus and methods incorporating modifications and variations will be obvious to one skilled in the art of fluid flow. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. An assembly for improving fan operating efficiency comprising, in combination, an axial flow fan having a plurality of blade tips, a shroud having a substantially circular opening for receiving said fan, a substantially continuous throat extending around said opening and disposed radially outward from said blade tips and an interior passage communicating with said substantially continuous throat, and means for providing air to said interior passage of said shroud.

2. The shroud assembly of claim 1 further including a curved surface adjacent said substantially continuous throat.

3. The shroud assembly of claim 2 wherein said curved surface functions as a Coanda surface and further including means for supplying air to said interior passage at a pressure of less than about 10 inches water gauge.

4. The shroud assembly of claim 2 wherein said substantially continuous throat defines a width extending generally perpendicularly to an adjacent portion of said adjacent curved surface.

5. The shroud assembly of claim 1 further including a plurality of webs disposed across said substantially continuous throat.

6. The shroud assembly of claim 1 wherein said shroud is axisymmetric about the axis of rotation of such fan.

7. The shroud assembly of claim 1 wherein said shroud is disposed adjacent a motor vehicle radiator and said fan is disposed upon and driven by a prime mover of such motor vehicle.

8. The shroud assembly of claim 1 wherein said means for providing air includes an air pump for providing air at a pressure of about 10 inches water gauge or less.

9. A fan assembly having improved efficiency comprising, in combination, an axial fan having a plurality of tips, a shroud having a substantially circular opening for receiving said fan and defining a plenum, a substantially continuous throat communicating with said plenum and disposed radially outward of said tips, and, a curved surface disposed adjacent said throat and extending substantially around said opening.

10. The shroud assembly of claim 9 wherein said curved surface functions as a Coanda surface when air flows through said throat.

11. The shroud assembly of claim 9 further including means for providing air under low pressure to said interior passage.

12. The shroud assembly of claim 9 further including a plurality of webs transversely disposed across said throat.

13. The shroud assembly of claim 9 further including means for providing air to said interior passage at a pressure of about 10 inches water gauge or less.

14. The shroud assembly of claim 9 wherein said shroud is disposed adjacent a motor vehicle radiator and said fan is disposed upon and driven by a prime mover of such motor vehicle.

15. The shroud assembly of claim 9 wherein said substantially continuous throat defines a width extending generally perpendicularly to an adjacent portion of said adjacent curved surface.

16. A shroud for the fan of a motor vehicle comprising, in combination, a fan mounted upon a prime mover and having a plurality of tips, a fan shroud having an opening for receiving such fan, a throat disposed radially outward from said tips, and an interior passage providing fluid communication with said throat, and means for providing air under low pressure to said interior passage.

17. The motor vehicle cooling system shroud of claim 16 wherein said curved surface functions as a Coanda surface and further including transversely oriented webs disposed in said throat.

18. The motor vehicle cooling system shroud of claim 16 wherein said shroud includes a plurality of inlet ports in fluid communication with said air providing means and said interior passage.

19. The motor vehicle cooling system shroud of claim 16 wherein said radial spacing between said fan and said opening of said shroud is about one inch.

20. The motor vehicle cooling system shroud of claim 16 further including a radiator disposed adjacent said shroud.

21. A method of improving the efficiency of a fan comprising the steps of:

providing a fan having a plurality of tips, providing a shroud having an opening for receiving such fan, a substantially continuous throat disposed radially outward from said fan tips and a curved surface extending from said throat toward said opening, and providing a flow of air to said throat.

22. The method of claim 21 wherein said curved surface functions as a Coanda surface and said flow of air travels generally along a portion of said surface after passing through said throat.

23. The method of claim 21 wherein said air is provided at a pressure of about 10 inches water gauge or less.

24. The method claim 21 wherein said throat defines a width and said width and said air pressure are adjusted to achieve a desired velocity profile.

* * * * *